US006032621A

United States Patent [19]

Tateshima

[11] Patent Number: 6,032,621

[45] Date of Patent: Mar. 7, 2000

[54] COOLING DEVICE FOR WATER COOLED ENGINE

[75] Inventor: Yoshinobu Tateshima, Wako, Japan

[73] Assignee: Honda Giken Kogyo Kabushiki Kaisha, Tokyo, Japan

[21] Appl. No.: 09/090,213

[22] Filed: Jun. 4, 1998

[30] Foreign Application Priority Data

Jun. 5, 1997 [JP] Japan ..... 9-148260

[51] Int. Cl.[7] ..... F02F 7/36

[52] U.S. Cl. ..... 123/41.82 R

[58] Field of Search ..... 123/41.82 R, 41.72

[56] References Cited

U.S. PATENT DOCUMENTS 1,642,293 9/1927 Bourne et al. ..... 123/41.75

FOREIGN PATENT DOCUMENTS 59-143823 9/1984 Japan .

*Primary Examiner*—Noah P. Kamen

*Attorney, Agent, or Firm*—Birch, Stewart, Kolasch & Birch, LLP

[57] ABSTRACT

A part attachment hole for attaching an accessory part, such an ignition plug, is formed in a substantially central part of a cylinder head of a water-cooled engine. A plurality of cylinder block attachment bolt holes are formed around the part attachment hole at a substantially equal pitch. A plurality of hose connection openings are formed between the plurality of cylinder block attachment bolt holes. Furthermore, a single radiator is connected via a radiator hose to the plurality of hose connection openings of the cylinder head having the above structure.

17 Claims, 8 Drawing Sheets

COOLING DEVICE FOR WATER COOLED ENGINE

BACKGROUND OF THE INVENTION

1. Field of the Invention

The present invention relates to a cooling device for a water-cooled engine.

2. Description of Background Art

A cooling device for a water-cooled engine is disclosed in Japanese Utility laid-Open No. Sho. 59-143823, entitled "Cooling Device for Water-Cooled Motorcycle."

According to the above-mentioned application, a cooling device includes pipes provided on respective lower sides of the two right and left radiators. The pieces are connected via a fork-like radiator hose to the inlet pipe of a water pump; the outlet pipe of the water pump is connected via a water hose to the cylinder of the engine; and the top end of the cylinder is connected via two water hoses to the respective top ends of the two radiators.

Small conventional water-cooled engines having relatively small emission, such as is mounted to a small motorcycle, is required to meet the following requirements:

(1) accessory parts, such as an ignition plug, are attachable to a substantially center part, when seen in plan view, of a cylinder head, for enhancing combustion efficiency of the engine;

(2) sealing is ensured at a joint between the cylinder block and the cylinder head;

(3) cooling efficiency of the cylinder head is enhanced; and, (4) the cylinder head has a space for attaching an accessory part, such as an ignition plug, a plurality of cylinder block attachment bolts, and a hose connection opening for connecting a hose for returning cooling water from the cooling water path of the cylinder head to the radiator.

SUMMARY AND OBJECTS OF THE PRESENT INVENTION

In order to meet the above requirements, the present invention provides a cooling device for a water-cooled engine in which a cooling water path of a cylinder head of the water-cooled engine is connected to a radiator via a radiator hose. The cylinder head has a part attachment hole for attaching an accessory part, such as an ignition plug, at a substantially central part, when seen in plan view, of the cylinder head. A plurality of cylinder block attachment bolt holes are formed around the part attachment hole at a substantially equal pitch. A hose connection opening is formed in a part sandwiched by the plurality of cylinder block attachment bolt holes. Furthermore, a plurality of hose connection openings are provided in the cylinder head and a single radiator is connected via a radiator hose to the plurality of hose connection openings.

Since a number of cylinder block attachment bolts are arranged around the part attachment hole, the hose connection opening is arranged in the part sandwiched by these cylinder block attachment bolts, and a plurality of hose connection openings are provided, a large space can be ensured at a substantially central part of the cylinder head so that an accessory part, such as an ignition plug, can be attached thereto with sufficient room.

Since a plurality of cylinder block attachment bolts are arranged at a substantially equal pitch, sealing the joint between the cylinder block and the cylinder head can be easily ensured.

Furthermore, since a hose connection opening is formed in a part sandwiched by the plurality of cylinder block attachment bolts, the number of hose connection openings can be easily increased. With an increased number of hose connection openings, each hose connection opening can have a smaller diameter. Therefore, a hose connection opening for running a necessary amount of cooling water can be arranged without interference with an accessory part, such as an ignition plug, and the plurality of cylinder block attachment bolts.

With an increased number of hose connection openings, cooling water can be made to flow substantially all over the cylinder head. Thus, the cooling efficiency of the cylinder head can be easily enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
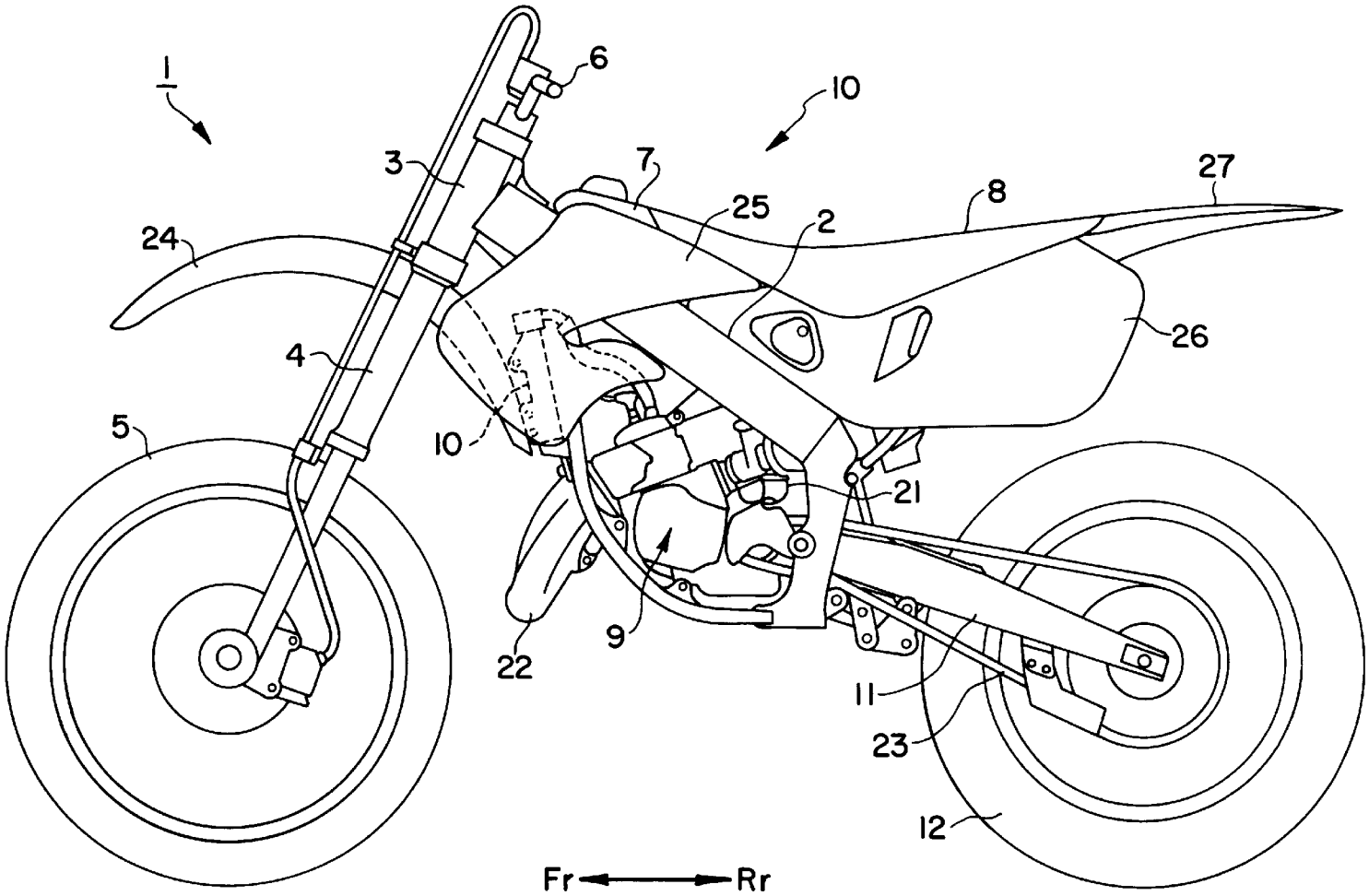
FIG. 1 is a side view of a motorcycle according to the present invention.

A preferred embodiment of the present invention will now be described with reference to the attached drawings. Note that terms "front," "rear," "left," "right," "upper," and "lower" represent respective directions viewed from the position of a driver, and Fr, Rr, L, and R respectively indicate a front side, a rear side, a left side, and a right side.

Also, some drawings should be viewed in the direction of reference numerals.

FIG. 1 is a side view of a motorcycle according to the present invention. A motorcycle 1 includes a cradle-type vehicle frame 2, a front fork 4 attached to a head pipe 3 of the vehicle frame 2, a front wheel 5 attached to the front fork 4, a handle 6 communicating with the front fork 4, a fuel tank 7 mounted on the front upper part of the vehicle frame 2, a seat 8 mounted on the rear upper part of the vehicle frame 2, a water-cooled engine 9 positioned within a cradle space surrounded by the respective pipes of the vehicle frame 2, a radiator 10 arranged in front of the water-cooled engine 9, a swing arm 11 attached to the rear part of the vehicle frame 2, and a rear wheel 12 attached to the swing arm 11.

In the drawing, 21 is a carburetor, 22 is an exhaust pipe, 23 is a drive chain, 24 is a front fender, 25 is a radiator shroud, 26 is a side cover, and 27 is a rear fender.

Figure 2:
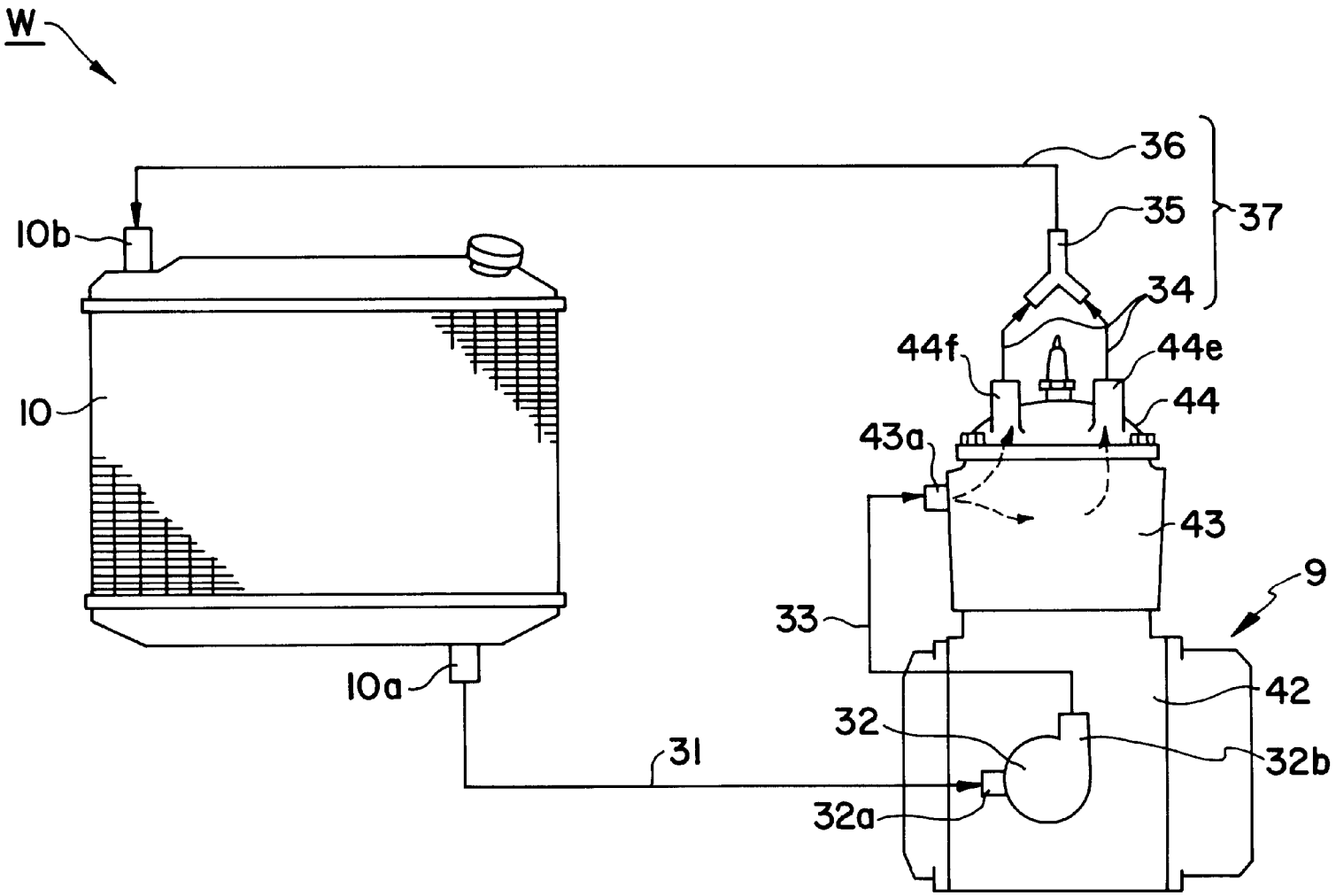
FIG. 2 is a diagram representing cooling water circulation relating to a cooling device for a water-cooled engine according to the present invention.

FIG. 2 is a drawing showing cooling water circulation relative to a cooling device of a water-cooled engine according to the present invention. The cooling device includes a cooling water circulation system W in which a cooling water outlet 10*a* of a single radiator is connected via an inlet hose 31 to the inlet 32*a* of a water pump 32. The outlet 32*b* of the water pump 32 is connected via the outlet hose 33 to the hose connection opening 43*a* of a cylinder block 43 (described later). The water jacket of the cylinder block 43 communicates with the water jacket of the cylinder head 44. Two hose connection openings 44*e*, 44*f* of the cylinder head 44 are respectively connected to one end of first return hoses 34, 34. The other ends of the first return hoses 34, 34 are connected via a fork-like hose joint 35 to one end of a second return hose 36. The other end of the second return hose 36 is connected to the cooling water return opening 10*b* of the radiator 10.

The above mentioned cooling water circulation system W operates such that cooling water from the radiator 10 is circulated to cool the water-cooled engine 9. The radiator hose 37 comprises a combination of two first return hoses 34, 34, a hose joint 35, and one second return hose 36.

Figure 3:
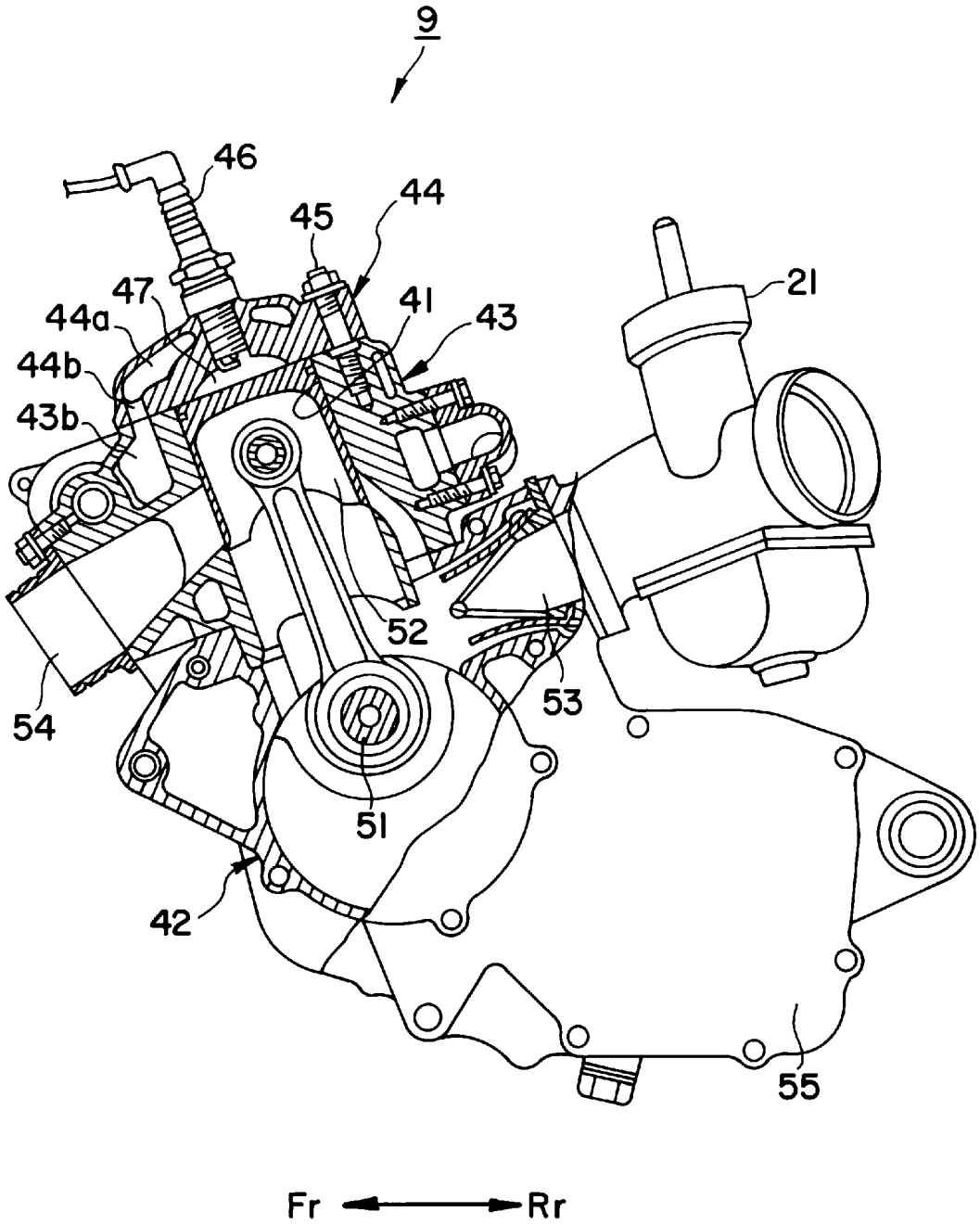
FIG. 3 is a left side view, partially in section, of a water-cooled engine according to the present invention.

FIG. 3 is a left side view, partly in section, of a water-cooled engine according to the present invention. The water-cooled engine 9 is a vertically-positioned two-cycle single-cylinder engine having one cylinder 41 extending substantially vertically. This engine comprises a crankcase 42, a cylinder block 43, and a cylinder head 44 which are all stacked on top of one another and connected together via a bolt. Specifically, the cylinder block 43 and the cylinder head 44 are connected via a bolt 45. Water jackets (a cooling water path) 43*b*, 44*a* are made to communicate with each other.

The cylinder head 44 has an ignition plug 46, or an accessory part, attached at its tip end (substantially at the center in plan view). Thus, since ignition takes place from the middle of the top of the combustion chamber 47, the water-cooled engine has improved combustion efficiency.

In the drawing, 51 is a crank shaft, 52 is a piston, 53 is an inlet opening, 54 is an outlet opening, and 55 is a power unit.

Figure 4:
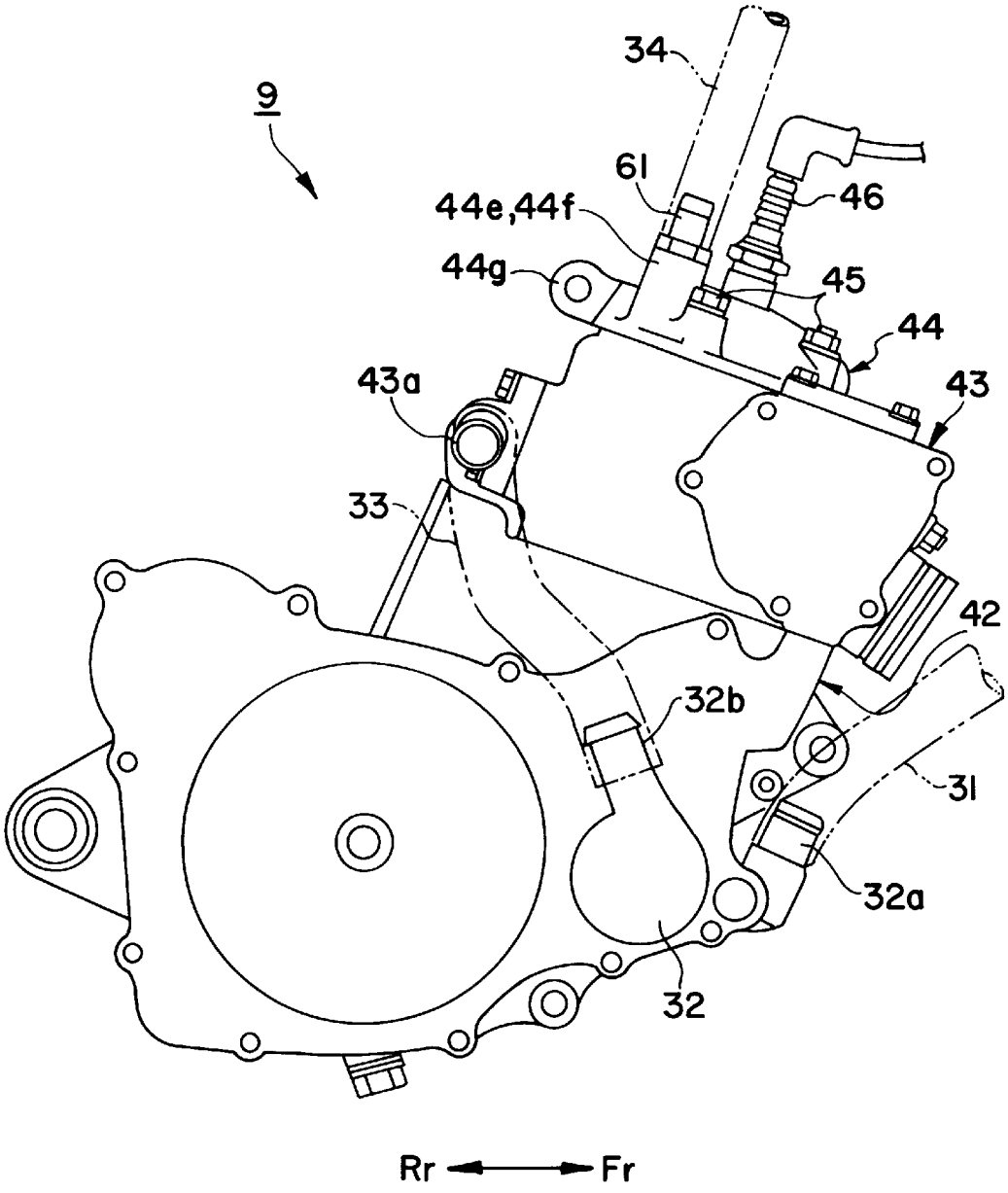
FIG. 4 is a right side view of a water-cooled engine according to the present invention.

FIG. 4 is a right side view of a water-cooled engine according to the present invention, which shows the water-cooled engine of FIG. 3 viewed from the rear side.

The water-cooled engine 9 comprises a water pump 32 attached to the side of the cylinder block 43. This drawing shows a specific structure in which an inlet hose 31 is connected to the inlet opening 32*a* of the water pump 32, and the outlet 32*b* of the water pump 32 is connected via an outlet hose 33 to the hose connection opening 43*a* of the cylinder block 43.

Figure 5:
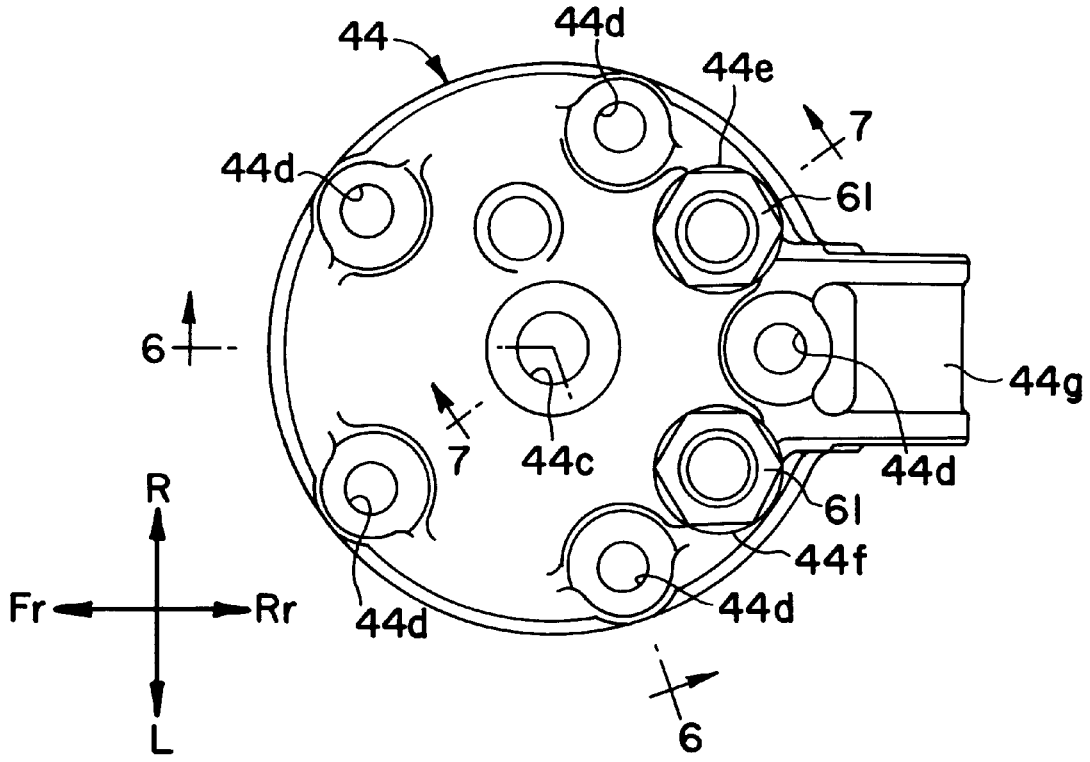
FIG. 5 is a plan view of a cylinder head according to the present invention.

FIG. 5 is a plan view of the cylinder head according to the present invention. The cylinder head 44 has, on level surfaces, a part attachment hole 44*c*, a plurality of cylinder block attachment bolt holes 44*d*, and two hose connection openings 44*e*, 44*f*.

More specifically, the cylinder head 44 has a part attachment hole 44*c* formed at a substantially central part thereof (see FIG. 3) for attaching an ignition plug 46, and a plurality of, for example five, cylinder block attachment bolt holes 44*d* formed around the part attachment hole 44*c* at a substantially equal pitch. Furthermore, two hose connection openings 44*e*, 44*f* are formed on or in the vicinity of a circle formed by the plurality of cylinder block attachment bolt holes 44*d*.

That is, a plurality of cylinder block attachment bolt holes 44*d* are arranged around the part attachment hole 44*c* and hose connection openings 44*e*, 44*f* are formed sandwiched between the cylinder block attachment bolt holes 44*d*.

In the drawing, 44*g* is a hanger for attaching the cylinder head 44 to a vehicle frame (not shown).

Figure 6:
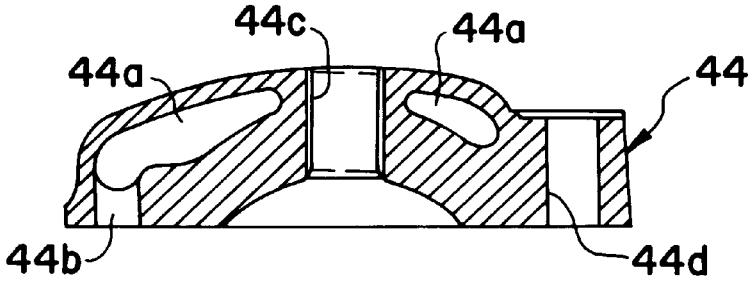
FIG. 6 is a sectional view of the cylinder head of FIG. 5 along the line 6—6.

FIG. 6 is a sectional view of the cylinder head of FIG. 5 along the line 6—6. The water jacket 44*a* has a communicating hole 44*b* communicating with the water jacket 43*b* of the cylinder block 43 shown in FIG. 3. The part attachment hole 44*c* is a vertically pierced-through screw hole. The cylinder block attachment bolt hole 44*d* is a vertically pierced-through hole, through which the bolt 45 of FIG. 3 passes.

Figure 7:
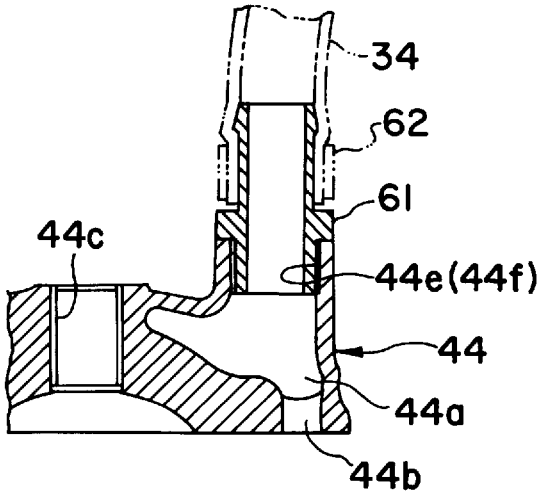
FIG. 7 is a sectional view of the cylinder head of FIG. 5 along the line 7—7.

FIG. 7 is a sectional view of the cylinder head of FIG. 5 along the line 7—7. The hose connection openings 44*e*, 44*f* of the cylinder head 44 are screw holes communicating with the water jacket 44*a*. A hose joint (a hose nipple) 61 is screwed into each of these screw holes so that the first return hose 34 is pressed onto the hose joint 61 and stopped by a hose clamp (hose band) 62.

Figure 8:
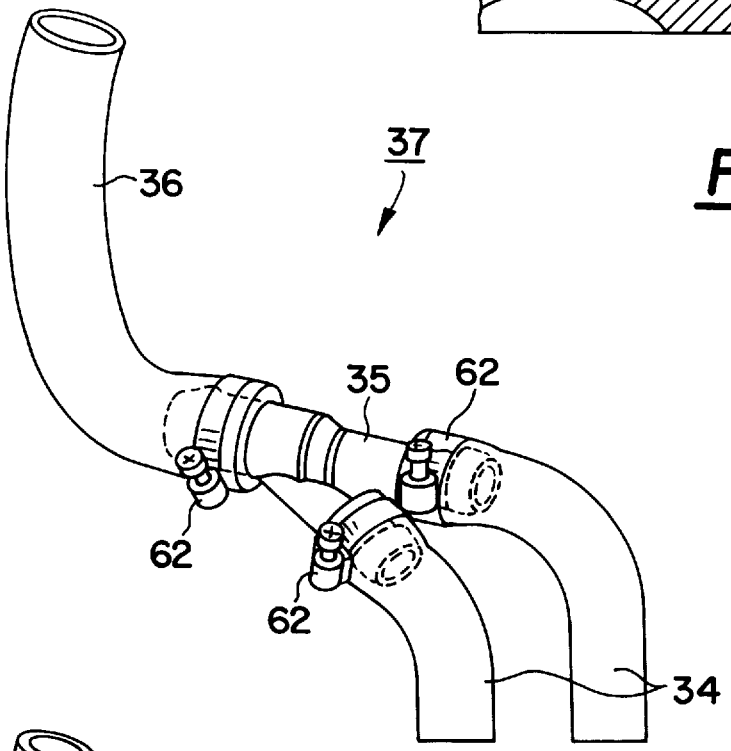
FIG. 8 is a perspective view of a radiator hose according to the present invention.

FIG. 8 is a perspective view of a radiator hose according to the present invention. In the radiator hose 37, the two connection parts of the fork-like (Y-type) hose joint 35 are respectively pressed into the first return hoses 34, 34, and the hoses 34, 34 are stopped by hose clamps 62, 62. The other connection part of the hose joint 35 is pressed into the second return hose 36, and the hose 36 is stopped by a hose clamp 62.

Figure 9:
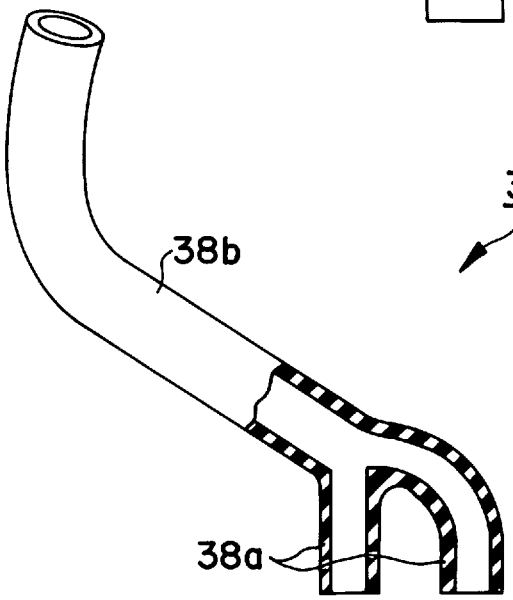
FIG. 9 is a perspective view of a radiator hose (modification) according to the present invention.

FIG. 9 is a perspective view of a radiator hose (modification) according to the present invention. A modified radiator hose 38 has a structure in which two first return hose sections 38*a*, 38*a* corresponding to the first return hoses 34, 34 of FIG. 8, and one second return hose section 38*b* corresponding to the second return hose 36 are integrally formed so that a fork-like hose joint 35 is eliminated. According to this modification, the hose joint 35 and three hose clamps 62 attached to the hose joint 35 are unnecessary, so that the number of parts can be reduced and a process for connecting the hose to the hose joint 35 is unnecessary.

Figure 10:
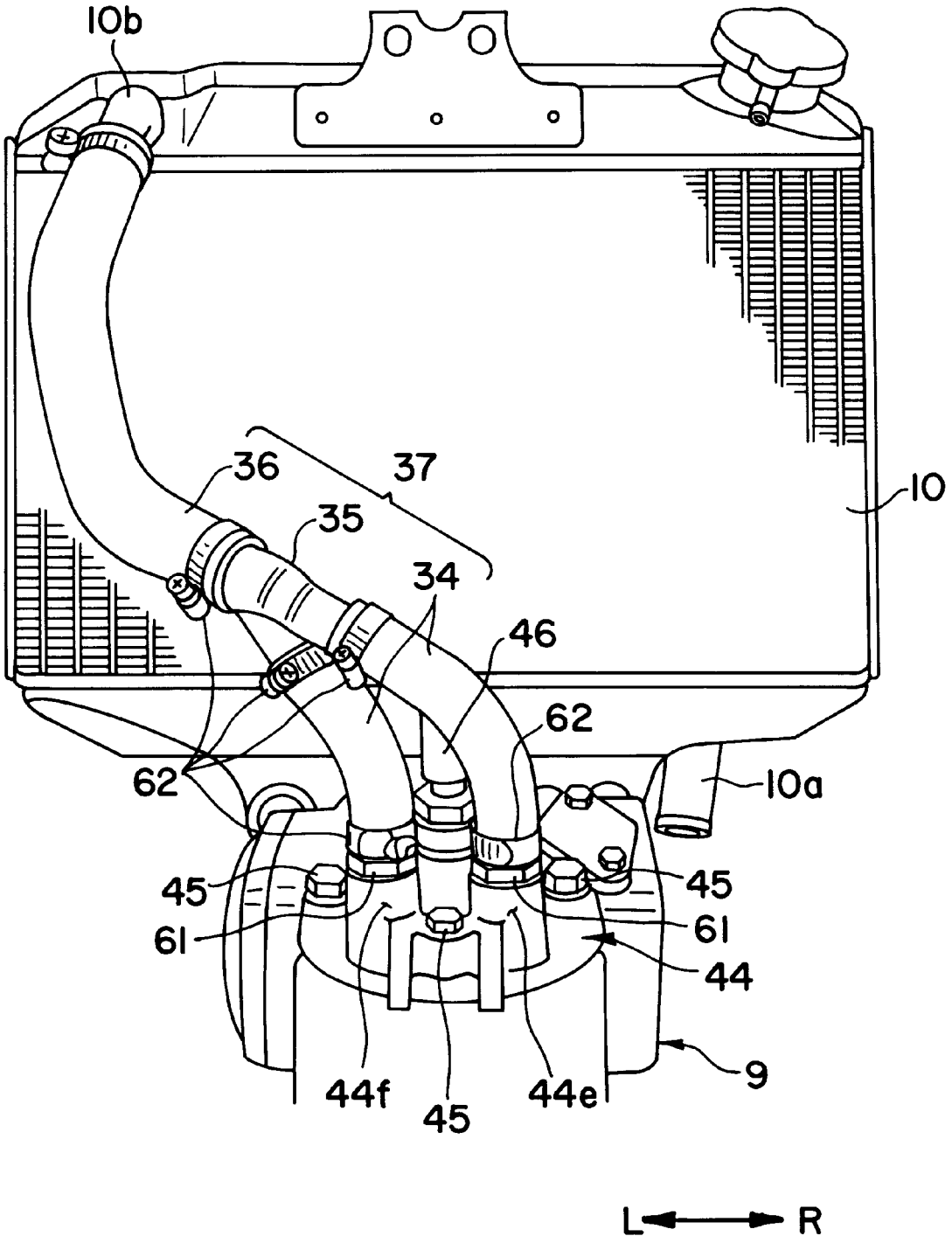
FIG. 10 is a diagram corresponding to FIG. 1 viewed in the direction of arrow 10.

FIG. 10 is a diagram corresponding to FIG. 1 viewed in the direction of the arrow 10, presenting the radiator 10 and the cylinder head 44 viewed diagonally from the upper rear side. This drawing shows a specific structure in which two hose connection openings 44*e*, 44*f* of the cylinder head 44 are connected via the radiator hose 37 to the cooling water returning opening 10*b* of the radiator 10. In the specific structure of the cooling water circulation system W, a cylinder head 44 is connected via the hose joints 61, 61 to one end of two first return hoses 34, 34, which are then converged by the hose joint 35, and the end of one second return hose 36 is connected to the cooling water return opening 10*b* of the radiator 10. Since two first return hoses 34, 34 are converged into one second return hose 36 before being connected to the cooling water return opening 10*b* of the radiator 10, the cooling water return opening 10*b* can be more freely positioned.

The radiator 10 having a substantially rectangular rear surface has a single cooling water outlet 10*a* formed on the lower right side corner thereof, and a single cooling water return opening 10*b* on the upper left side corner thereof. With this arrangement, the cooling water outlet 10*a* and the cooling water return opening 10*b* are arranged substantially diagonally. Therefore, cooling water can run substantially consistently all through the radiator 10, which improves the cooling efficiency of the radiator 10.

Next, the operation of the cooling device for a water-cooled engine having the above structure will be described with reference to FIGS. 3 and 5. Referring to FIG. 5, a plurality of cylinder block attachment bolt holes 44*d* and a plurality of hose connection openings 44*e*, 44*f* are formed on or in the vicinity of the circle formed by the plurality of cylinder block attachment bolt holes 44*d* around the part attachment hole 44*c*. Therefore, a large airspace can be ensured at the center part of the circle so that there is sufficient room to be able to install an ignition plug 46 therein (see FIG. 3). That is, a plurality of cylinder block attachment bolt holes 44*d* are arranged around the part attachment hole 44*c*, and hose connection openings 44*e*, 44*f* are formed sandwiched between the cylinder block attachment bolt holes 44*d*. With this arrangement, a large space can be ensured at a substantially central part of the cylinder head 44.

When an ignition plug 46 is installed at the substantially central part of the cylinder head 44, the combustion efficiency of the water-cooled engine 9 of FIG. 3 is enhanced.

Since a plurality of bolt holes 44*d* (a bolt 45 in FIG. 3) are arranged at substantially the same pitch, sealing at the joint between the cylinder block 43 and the cylinder head 44 of FIG. 3 can be ensured without enhancing rigidity around the circle of bolt holes 44*d* in the cylinder head 44. Therefore, the cylinder head 44 can be lighter.

Furthermore, since hose connection openings 44*e*, 44*f* are formed on or in the vicinity of the circle formed by the plurality of cylinder block attachment bolt holes 44*d* (i.e., hose connection openings 44*e*, 44*f* are formed sandwiched between the plurality of cylinder block attachment bolt holes 44*d*), the number of hose connection openings can be easily increased. With an increased number of hose connection openings, each of the hose connection openings 44*e*, 44*f* can have a smaller diameter. It is therefore possible to form hose connection openings 44*e*, 44*f* for running necessary cooling water without interference with the ignition plug 46 or the plurality of cylinder block attachment bolts 45.

Furthermore, when the number of hose connection openings 44*e*, 44*f*, is increased, it is possible to run the cooling water substantially all through the cylinder head 44. The cooling efficiency of the cylinder head 44 can thus be easily improved.

Figure 11:
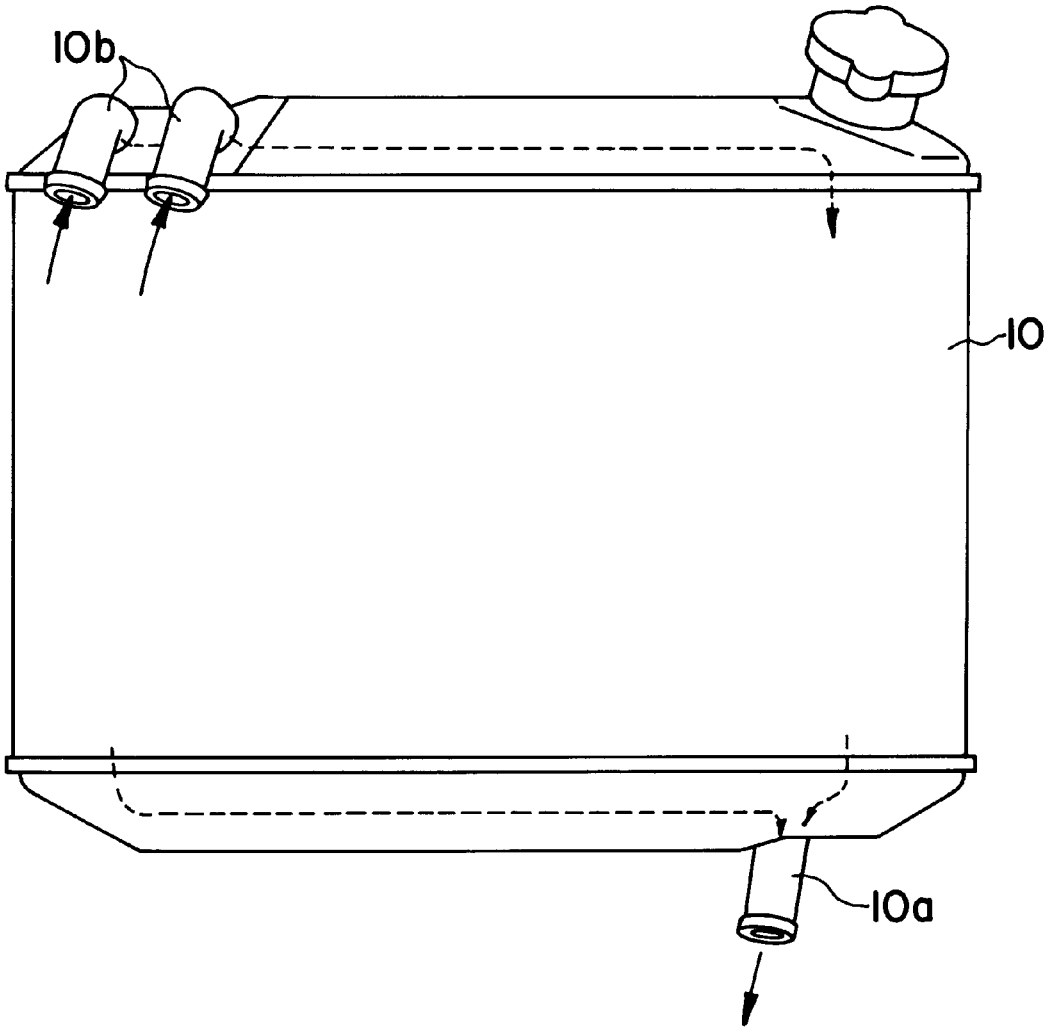
FIG. 11 is a perspective view of a radiator (modification) according to the present invention.

FIG. 11 is a perspective view of a radiator (modification) of the present invention. A modified radiator 10 has two cooling water returning openings 10*b*, 10*b* arranged side by side. Also, in this case, the two cooling water returning openings 10*b*, 10*b* and the cooling water outlet 10*a* are arranged substantially diagonally. Therefore, similarly to the radiator 10 shown in FIG. 10, the cooling water can run substantially all through the modified radiator 10, which improves cooling efficiency. Note that in this modification, since the two first return hoses 34, 34 shown in FIG. 10 can be directly attached to the two cooling water return openings 10*b*, 10*b*, the number of parts can be reduced, and a process of connecting the hose to the hose joint 35 can be eliminated.

It should be noted that, in the above-mentioned embodiment, the water-cooled engine 9 is not limited to the structure for being mounted to a motorcycle 1. The water-cooled engine of the present invention may be used in an industrial engine.

The direction of the cylinder head 44 is determined according to the direction of the water-cooled engine 9. However, in this invention, the surface of the cylinder head 44 for attaching to the cylinder block 43 and the opposite surface are referred to as "a plane."

Accessory parts to be attached to the part attachment hole 44*c* of the cylinder head 44 may be any accessories, including, for example, a fuel injection valve and a pressure sensor, in addition to an ignition plug 46.

The number of hose connection openings formed in the cylinder head 44 may be more than one, and determined as required.

The hose connection opening 44*e*, 44*f* may be formed sandwiched between the plurality of cylinder block attachment bolt holes 44*d*, and is not limited to the structure in which they are formed on a circle formed by the plurality of cylinder block attachment bolt holes 44*d*.

The hose joint 35 for converging a plurality of first return hoses 34, 34 may be directly attached to the cooling water return opening 10*b* of the radiator 10 through welding or other means. In this case, the second return hose 36 is unnecessary.

The present invention offers the following advantages with the above structure. According to the present invention, there is provided a cooling device for a water-cooled engine in which a cooling water path of a cylinder head of the water-cooled engine is connected to a radiator via a radiator hose. The cylinder head has a part attachment hole for attaching an accessory part, such as an ignition plug, at a substantially central part of the cylinder head. A plurality of cylinder block attachment bolt holes are formed around the part attachment slot at a substantially equal pitch. A hose connection opening is formed in a part sandwiched by the plurality of cylinder block attachment bolt holes. A plurality of hose connection openings are provided and a single radiator is connected via a radiator hose to the plurality of hose connection openings.

A plurality of cylinder block attachment bolt holes are arranged around a part attachment hole, a hose connection opening is formed in a part sandwiched by the cylinder block attachment bolt holes and a plurality of hose connection openings are provided. A large space can thus be ensured at a substantially central part of the cylinder head, so that there is sufficient room to attach an accessory part, such as an ignition plug.

Since a plurality of cylinder block attachment bolts are arranged at a substantially equal pitch, sealing at the joint between the cylinder block and the cylinder head can be ensured. Also, since a hose connection opening is formed in a part sandwiched by the plurality of cylinder block attachment bolt holes, the number of hose connection openings can be easily increased. With an increased number of hose connection openings, each of the hose connection openings can have a smaller diameter. Thus, it is possible to arrange a hose connection opening for flowing necessary cooling water without interference with an accessory part, such as an ignition plug, and the plurality of cylinder block attachment bolts. Also, with an increased number of hose connection openings, cooling water can be made to flow substantially all through the cylinder head. Thus, the cooling efficiency of the cylinder head can be easily enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A cooling device for a water-cooled engine comprising:

a cylinder head;

a part attachment hole, for attaching an accessory part, formed in said cylinder head at substantially a center of said cylinder head;

a plurality of cylinder block attachment bolt holes formed around said part attachment hole at a substantially equal distance from said part attachment hole;

a plurality of hose connection openings formed between said plurality of cylinder block attachment bolt holes;

a cooling water path formed in said cylinder head said cooling water path is in communication with said plurality of hose connection openings; and a radiator connected to said cooling water path of said cylinder head by a radiator hose, said radiator hose is connected between said plurality of hose connection openings and said radiator.

2. The cooling device for a water-cooled engine according to claim 1, wherein a radial distance of said plurality of hose connection openings from said part attachment hole is generally the same as a radial distance of said plurality of cylinder block attachment bolt holes from said part attachment hole.

3. The cooling device for a water-cooled engine according to claim 1, wherein there are two of said plurality of hose connection openings, said radiator hose including a first end attached to said radiator and a second end attached to said two hose connection openings.

4. The cooling device for a water cooled engine according to claim 3, said radiator hose further comprising:

a first return hose connected to one of said two hose connection openings;

a second return hose connected to the other of said two hose connection openings;

a third return hose connected to said radiator; and a hose joint in communication with said first, second and third return hoses.

5. The cooling device for a water cooled engine according to claim 3, wherein said radiator hose is a single hose having an inlet attached respectively to each of said two hose connection openings and an outlet attached to said radiator.

6. The cooling device for a water-cooled engine according to claim 1, wherein a spark plug is received in said part attachment hole.

7. The cooling device for a water-cooled engine according to claim 1, wherein a communicating hole is formed in said cylinder head, said communicating hole being in communication with said cooling water path for communicating said cooling water path to a water path in a cylinder block.

8. The cooling device for a water cooled engine according to claim 1, wherein there are two of said hose connection openings, said radiator includes two inlets and one outlet, and each of said hose connection openings is connected to a respective of said inlets of said radiator.

9. A cooling device for a water-cooled engine comprising:

a cylinder head;

a part attachment hole formed in said cylinder head;

a plurality of cylinder head bolt holes formed in said cylinder head circumferentially around said part attachment hole at a substantially equal distance from said part attachment hole;

two hose connection openings formed in said cylinder head, each of said hose connection openings located generally between adjacent cylinder head bolt holes of said plurality of said cylinder head bolt holes; and a radiator hose including a first end attachable to a radiator and a second end attached to said two hose connection openings.

10. The cooling device for a water-cooled engine according to claim 9, further comprising a cooling water path formed in said cylinder head, said cooling water path in communication with said at least one hose connection opening.

11. The cooling device for a water cooled engine according to claim 10, wherein said cooling device further comprises a radiator, said radiator includes two inlets and one outlet, and each of said hose connection openings is connected to a respective of said inlets of said radiator.

12. The cooling device for a water cooled engine according to claim 9, said radiator hose further comprising:

a first return hose connected to one of said two hose connection openings;

a second return hose connected to the other of said two hose connection openings;

a third return hose connectable to said radiator; and a hose joint in communication with said first, second and third return hoses.

13. The cooling device for a water cooled engine according to claim 9, wherein said radiator hose is a single hose having an inlet attached respectively to each of said two hose connection openings and an outlet attachable to said radiator.

14. The cooling device for a water-cooled engine according to claim 9, wherein a radial distance of said two hose connection openings from said part attachment hole is generally the same as a radial distance of said plurality of cylinder block attachment bolt holes from said part attachment hole.

15. The cooling device for a water-cooled engine according to claim 9, wherein a spark plug is received in said part attachment hole.

16. The cooling device for a water-cooled engine according to claim 9, wherein a communicating hole is formed in said cylinder head, said communicating hole being in communication with said cooling water path for communicating said cooling water path to a water path in a cylinder block.

17. The cooling device for a water-cooled engine according to claim 9, wherein said part attachment hole is formed at a substantially central position in said cylinder head.

* * * * *